United States Patent [19]

Abe et al.

[11] 4,148,182

[45] Apr. 10, 1979

[54] BUZZER MECHANISM FOR ALARM CLOCK OR THE LIKE

[75] Inventors: Shuzo Abe; Yukio Endo; Yoshito Otsuki, all of Okaya, Japan

[73] Assignee: Kabushiki Kaisha Seikosha, Japan

[21] Appl. No.: 790,985

[22] Filed: Apr. 26, 1977

[30] Foreign Application Priority Data

Apr. 26, 1976 [JP] Japan ..... 51-47481
Aug. 3, 1976 [JP] Japan ..... 51-92479

[51] Int. Cl.[2] ..... G04C 21/16

[52] U.S. Cl. ..... 58/16 R; 58/19 R; 58/38 R

[58] Field of Search ..... 58/7, 9, 16 R, 22, 38 R, 58/39.5, 57.5, 21.15, 21.15 S, 19 R, 21.13; 340/396, 401, 402

[56] References Cited

U.S. PATENT DOCUMENTS

| | | | |
|---|---|---|---|
| 2,768,332 | 10/1956 | Protzmann et al. | 58/21.15 |
| 3,314,228 | 4/1967 | Bowden | 58/38 R |
| 3,328,952 | 7/1967 | Clark | 58/16 R |
| 3,708,973 | 1/1973 | Funaki | 58/19 R |

*Primary Examiner*—Robert K. Schaefer
*Assistant Examiner*—Vit W. Miska
*Attorney, Agent, or Firm*—Robert E. Burns; Emmanuel J. Lobato; Bruce L. Adams

[57] ABSTRACT

A buzzer mechanism for an alarm clock or the like comprises a vibrator member rockably supported on a base plate for angular movement between an inactive position and an active position in which a vibration arm of the vibrator faces a buzzer yoke associated with the alternating driving coil of the clock so as to be vibrated. A coil spring presses the vibrator member against the base plate and also biases it toward active position. A projection on the vibrator member engages the hour wheel so that when the hour wheel is moved axially upon a projection on the hour wheel coming into registry with a hole in an unlocking drum, the vibrator member is permitted to rock to active position. An alarm stop lever is operable manually to return the vibrator member to inactive position.

11 Claims, 2 Drawing Figures

BUZZER MECHANISM FOR ALARM CLOCK OR THE LIKE

FIELD OF INVENTION

The present invention relates to a buzzer mechanism for an alarm clock or the like.

BACKGROUND OF THE INVENTION

In a conventional buzzer called the stator-buzzer type, a buzzer vibrator is fixed at one end to a stationary member and is vibrated by making use of the magnetic flex from the stator of a motor for driving the clock. In a conventional mechanism of this kind the vibrator is changed between operating state and non-operating state through an alarm switch lever linking with an unlocking mechanism. As many component parts are required, the structure becomes complex and laborious to assemble with consequent high cost of manufacture.

SUMMARY OF THE INVENTION

It is an object of the present invention to eliminate the disadvantage described above. Thus an object of the present invention is to provide a buzzer mechanism which is simple in structure by dispensing with an intermediate part between the unlocking mechanism and the vibrator. Another object of the present invention is to provide a buzzer mechanism which operates steadily and produces a good buzzer sound.

According to a feature of the present invention, there is provided a buzzer mechanism for an alarm clock or the like comprising an unlocking mechanism including an unlocking drum and an hour wheel and a vibrator rockably supported on a base plate and provided with a projection contacting the hour wheel and with a vibration arm. The vibrator member is biased toward the hour wheel so that when the hour wheel moves axially the vibration arm is brought into the magnetic field of a buzzer yoke connected with the stator of a motor for driving the clock so as to produce a buzzer sound. A stop lever is operable manually to rock the vibrator member back to an inoperative position. The vibrator mechanism in accordance with the present invention is thus of simple construction whereby it is less expensive to manufacture and is reliable and durable in its operation.

BRIEF DESCRIPTION OF DRAWINGS

The nature, object and advantages of the invention will be more fully understood from the following description of preferred embodiments shown by way of example in the accompanying drawings in which.

DESCRIPTION OF PREFERRED EMBODIMENTS

Figure 1:
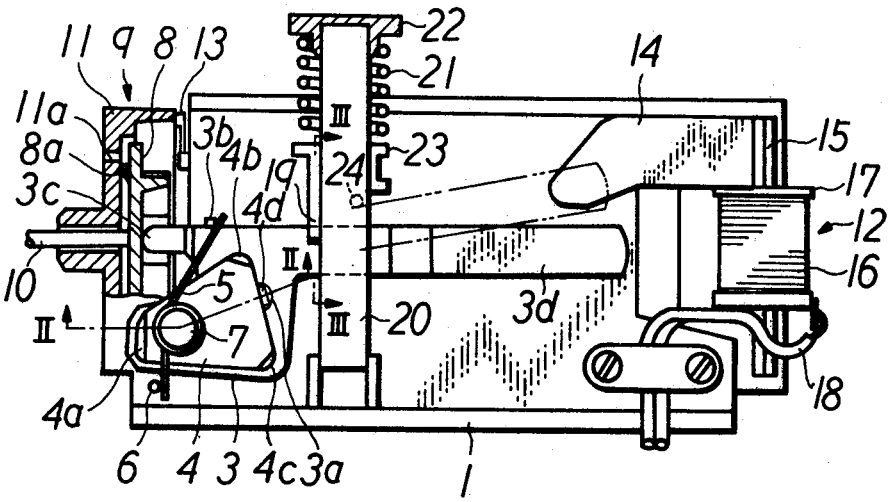
FIG. 1 is an elevational view partly in section of an embodiment of the present invention.
Figure 2:
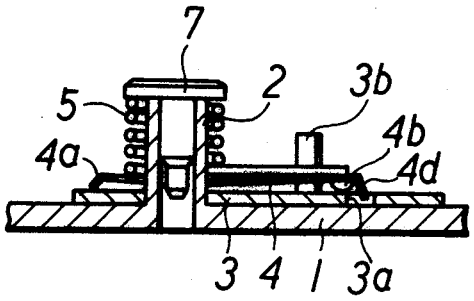
FIG. 2 is an enlarged section along the lines II—II in FIG. 1.

Referring to FIGS. 1 and 2, a base plate 1 is provided with a tubular projection or pipe 2. A vibrator member 3 is rockably supported about the pipe 2. The vibrator member 3 also functions as an alarm switch lever. A push plate 4 made of spring material is rotatably supported about the pipe 2. The push plate 4 is provided with three protuberances or legs 4*a*, 4*b* and 4*c* which engage the vibrator member 3. A coil spring 5 is provided around the pipe 2. The coil spring 5 pushes the vibrator 3 through the push plate 4 to the base plate 1. The push plate 4 is provided with a bent hook portion 4*d* engaged with a hole 3*a* provided in the vibrator member 3 so that the push plate 4 and the vibrator member 3 rock together. One end portion of the coil spring 5 is engaged with a pin 6 on the base plate 1 while the other end engages with a projection 3*b* on the vibrator member 3 thereby applying counterclockwise rotational force to the vibrator member. A stud 7 is secured to the pipe 2 and holds down the coil spring 5. Thus the coil spring 5 presses the vibrator member 3 against the base plate 1 and also biases the vibrator member 3 in a counterclockwise direction.

The vibrator member 3 is provided at its upper left end portion with a projection 3*c* which abuts against the right side of an hour wheel 8 by reason of the bias of the coil spring 5. The hour wheel 8 is a component part of unlocking mechanism 9. As the hour wheel 8 moves in an axial direction from the position shown, the vibrator member 3 is permitted to rock in a counterclockwise direction. The unlocking mechanism 9 is conventional. A minute shaft 10 penetrates through the center of the hour wheel 8 and an unlocking drum 11 is rotatable about the shaft 10. The unlocking drum 11 is rotatable manually to set the alarm time. The hour wheel 8 is rotated once in 24 hours by a motor 12 through reducing gear mechanism (not shown in the drawings). The hour wheel 8 is provided on its left side with a triangular projection 8*a* and the unlocking drum 11 is provided with a hole 11*a* engageable with such projection when the hour wheel has rotated to a position corresponding to the time for which the unlocking drum 11 is set. A click spring 13 is provided for preventing reverse rotation of the unlocking drum 11.

The vibrator member 3 is provided with a raised vibration arm 3*d* extending toward the right. The vibration arm 3*d* is so designed that it may be moved to a position opposing a buzzer yoke 14. The buzzer yoke 14 is L-shaped and is connected with the stator 15 of the motor 12. A coil 16 is wound around the buzzer yoke 14 and the stator 15 on a bobbin 17. A power source cord 18 is connected to the coil 16.

The base plate 1 is provided with a stopper 19 which defines the range of rocking movement of the vibrator member 3 and keeps a predetermined gap between the raised vibration arm 3*d* and the buzzer yoke 14.

An alarm stop lever 20 is slidable up and down on the base plate 1. A coil spring 21 is wound around the alarm stop lever 20 between a pushbutton 22 on the alarm stop lever and a guide member 23 projecting from the base plate 1 so as to bias the stop lever 20 upwardly. The alarm stop lever 20 is provided on its backside with a pin 24 which is engageable with an upper portion of the vibrator member 3. When the pushbutton 22 is pushed downwardly the pin 24 engages the vibrator member 3 so as to rotate it in a clockwise direction from the operative position in which the vibration arm 3*d* faces the buzzer yoke 14, as shown in dot-dash lines in FIG. 1, to an inoperative position, shown in solid lines in FIG. 1, in which the vibration arm 3*d* is apart from the buzzer yoke 14.

In operation an alarm time is set by turning the unlocking drum 11. At the set time the triangular projection 8*a* on the hour wheel 8 engages with the hole 11*a* in the unlocking drum 11 and the hour wheel 8 moves toward the left. This permits the vibrator member 3 to turn counterclockwise around the pipe 2 until the vibration arm 3*d* faces the buzzer yoke 14, as shown in dot-dash lines in FIG. 1. The magnetic flux of the buzzer yoke 14 produces vibration of the vibration arm 3*d* which in turn strikes the buzzer yoke to produce the buzzer sound.

In this type of buzzer it is essential to keep the vibration arm 3*d* spaced from the buzzer yoke 14 by a predetermined distance. Since the vibrator member 3 is rockably supported, it is difficult to keep the space constant. To overcome this difficulty the push plate 4 is provided for applying pressure by the coil spring 5 to the vibrator member 3 by its three legs 4*a*, 4*b* and 4*c*. By reason of application of pressure in this manner, the vibrator plate 3 always contacts the base plate 1 over a wide area and variation of the space between the vibration arm and the buzzer yoke 14 is minimized. In case the pressure the vibrator member 3 applies to the base plate is too weak, the above described effect decreases and in case the pressure is too strong, the rocking motion of the vibrator member 3 is hindered. The force of the coil spring 5 and the spring force of the push plate 4 are therefore suitably designed. Since the vibrator member 3 is pressed at its base portion by the push plate 4 as though it is fixed by the push plate, the vibration arm 3*d* performs vibratory motion similar to that of a cantilever. The vibrator accordingly produces a good buzzer sound without rattle.

Figure 3:
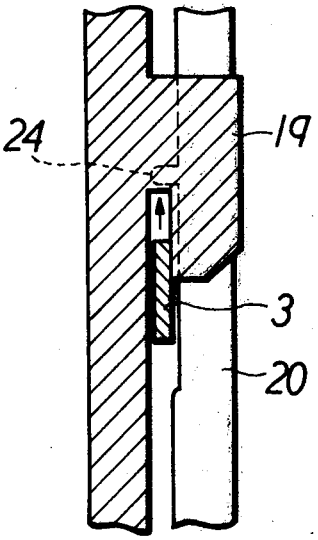
FIG. 3 is an enlarged section along the lines III—III in FIG. 1.
Figure 4:
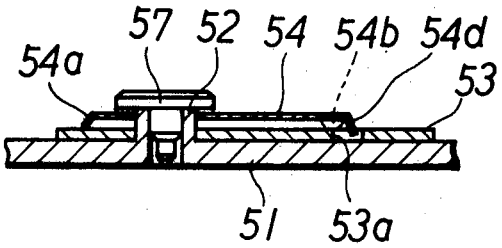
FIG. 4 is an enlarged section similar to FIG. 2 but showing a modification.

In a modification as illustrated in FIG. 4, the coil spring 5 is eliminated and the vibrator member 53 is pushed against the base plate 51 by a spring push plate 54 which is held down by a stud 57 secured in the pipe 52 and is provided with three downwardly bent leg portions of which only two of the portions 54*a* and 54*b* are shown and with a downwardly bent hook portion 54*d* engaged with a hole 53*a* in the vibrator member 53. In this case the vibrator member 53 is forced to turn in a counterclockwise direction by a separately provided coil spring (not shown in the drawings). The embodiment of FIG. 4 is otherwise like that of FIGS. 1 to 3.

What is claimed is:

1. Buzzer mechanism for an alarm clock or the like comprising:

a base plate, an electric motor for driving said clock or the like, said motor being mounted on said base plate and having a stator and a coil for energizing said stator to produce magnetic flux, a buzzer yoke magnetically coupled with said stator so as to be energized by said coil and being adapted to receive and activate a vibrator member, a vibrator member pivotally mounted on said base plate for pivotal movement between an active position in which it is received and vibrated by said buzzer yoke and an inactive position in which it is removed from said yoke and not vibrated thereby, means for biasing said vibrator member rotationally to said active position, and settable time controlled means for normally holding said vibrator member in inactive position against the action of said bias and for releasing said vibrator member at a preset time for movement by said biasing means to said active position whereupon it is vibrated by said buzzer yoke.

2. Buzzer mechanism according to claim 1, wherein said vibrator is rockable about a pivot post on said base plate, and wherein said means for pressing said vibrator member against said base plate comprises a resilient presser member which is rockable with said vibrator member about said pivot post.

3. Buzzer mechanism according to claim 1, wherein said settable time controlled means comprises an hour wheel of said clock or the like and an unlocking drum, said hour wheel and unlocking drum having cooperating means for movement of said hour wheel axially when the set alarm time is reached.

4. Buzzer mechanism according to claim 1, further comprising manually operable means for rocking said vibrator member from active position to inactive position.

5. Buzzer mechanism according to claim 1, wherein said buzzer yoke has a portion spaced from said base plate, said vibrator member having a vibration arm portion received between said buzzer yoke and said base plate when said vibrator member is in active position.

6. Buzzer mechanism according to claim 1, wherein said buzzer yoke has a portion spaced from said base plate and wherein said vibrator member has a portion adjacent its pivot pressed against said base plate and an extending vibration arm portion spaced from said base plate and received between said base plate and said buzzer yoke when said vibrator member is in active position.

7. Buzzer mechanism according to claim 1, further comprising means on said base plate for regulating the pivotal movement of said vibrator member to position said vibrating arm accurately with respect to said buzzer yoke when said vibrator member is in active position.

8. Buzzer mechanism according to claim 1, further comprising means acting on said vibrator member adjacent its pivot to press said vibrator member against said base plate.

9. Buzzer mechanism according to claim 8, wherein said vibrator is rockable about a pivot post on said base plate, and wherein said means for pressing said vibrator member against said base plate and for biasing said vibrator member rotationally comprises a coil spring on said post.

10. Buzzer mechanism according to claim 9, further comprising a resilient presser member rockable about said pivot post with said vibrator member, said presser member being between said spring and said vibrator member to transmit the force of said spring to said vibrator member and to distribute said force to an area of said vibrator member.

11. Buzzer mechanism for a clock or the like comprising:

an unlocking mechanism including an unlocking drum and an hour wheel, a base plate, a vibrator member rockably supported on said base plate and provided with a projection contacting said hour wheel and with a vibration arm, a push plate for pushing said vibrator member to said base plate, a coil spring for pushing said vibrator member to said hour wheel and for pushing said push plate to said vibrator member, a buzzer yoke for actuating said vibration arm, said buzzer yoke being connected to a stator of a motor for driving said clock, wherein as said vibrator member rocks simultaneously with operation of said unlocking mechanism, said vibration arm faces said buzzer yoke and is activated thereby to produce a buzzer sound.

* * * * *